United States Patent [19]

MacGregor

[11] 4,170,124

[45] Oct. 9, 1979

[54] HYDRAULIC CONTROL SYSTEM FOR PRESS BRAKES AND THE LIKE

[75] Inventor: Robert MacGregor, Blue Island, Ill.

[73] Assignee: Dreis & Krump Manufacturing Company, Chicago, Ill.

[21] Appl. No.: 860,235

[22] Filed: Dec. 13, 1977

Related U.S. Application Data

[60] Continuation of Ser. No. 620,930, Oct. 9, 1975, abandoned, which is a division of Ser. No. 359,220, May 11, 1973, Pat. No. 3,913,450.

[51] Int. Cl.[2] ..... B21D 7/06

[52] U.S. Cl. ..... 72/389; 60/421; 72/441; 72/446; 72/453.18; 92/146

[58] Field of Search ..... 72/441, 443, 389, 446, 72/453.01, 453.18; 60/421; 100/269 R, 257, 258 R, 258 A; 92/146, 13.6; 91/400, 410, 411 R, 390

[56] References Cited

U.S. PATENT DOCUMENTS

| | | | |
|---|---|---|---|
| 2,136,856 | 11/1938 | Long | 72/446 |
| 2,185,096 | 12/1939 | Treer | 100/258 R |
| 2,612,951 | 10/1952 | Palmleaf | 72/441 |
| 2,946,234 | 7/1960 | Jahnke | 100/257 |
| 3,162,232 | 12/1964 | Munschaver | 72/441 |
| 3,841,140 | 10/1974 | Hryc | 72/443 |

FOREIGN PATENT DOCUMENTS

| | | | |
|---|---|---|---|
| 620499 | 5/1961 | Italy | 72/441 |
| 526359 | 9/1940 | United Kingdom | 72/441 |

*Primary Examiner*—Francis S. Husar
*Assistant Examiner*—Gene P. Crosby
*Attorney, Agent, or Firm*—Lockwood, Dewey, Alex & Cummings

[57] ABSTRACT

A control and actuator system for a press brake having a frame, a bed, a ram, and a pair of hydraulic cylinders for reciprocating the ram, utilizes a jackscrew arrangement in conjunction with positive mechanical stops on the ram pistons to support the ram beneath the cylinders to enable the bottom travel limit of the ram to be preset. The top travel limit of the ram is preset by means of vertically adjustable actuator rods on the ram, which engage actuator stems on valves associated with each cylinder to stop upward travel and hold the ram in position. Tilt compensation is provided at the top and bottom ram limits by independent adjustment of the jackscrews and actuator rods, obviating the need for a complex tape and pulley driven differential valve arrangement. The novel hydraulic circuit provided for powering the cylinders utilizes pilot-driven control valves, and provides for direct venting of the system high-volume hydraulic pump when not in use to maximize system efficiency.

7 Claims, 4 Drawing Figures

FIG. 1
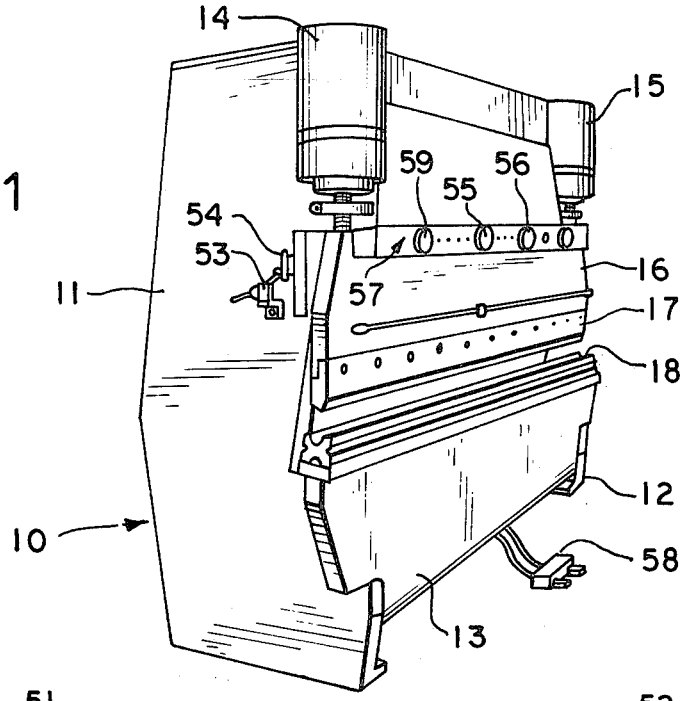
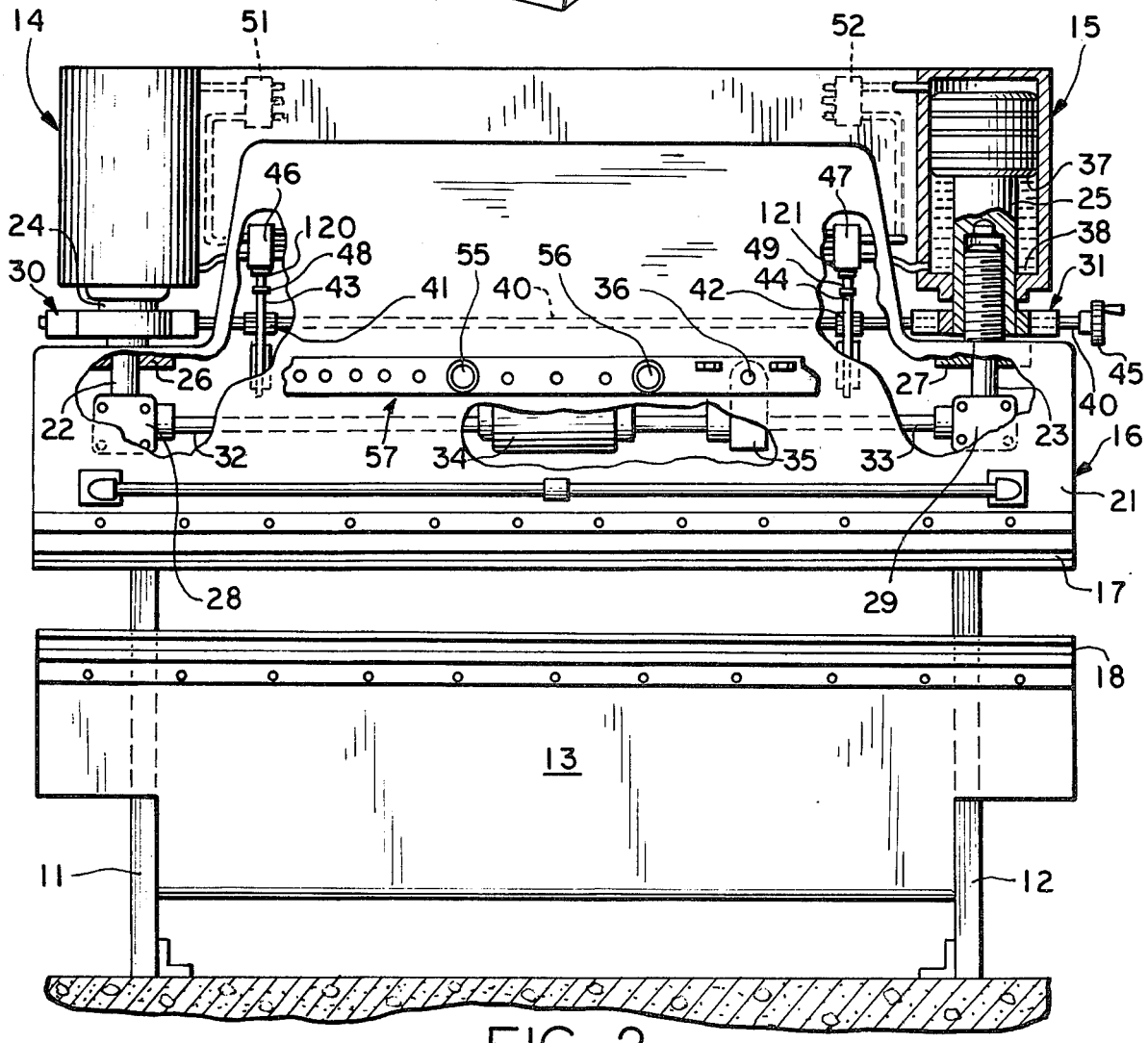
FIG. 2

HYDRAULIC CONTROL SYSTEM FOR PRESS BRAKES AND THE LIKE

This is a continuation of application Ser. No. 620,930 filed Oct. 9, 1975, now abandoned, which is a division of application Ser. No. 359,220, filed May 11, 1973, now U.S. Pat. No. 3,913,450.

BACKGROUND OF THE INVENTION

The present invention relates in general to press brake machines and more particularly to a hydraulic control and actuating system therefor.

Press brake machines of the type in common use generally consist of a pair of spaced-apart upstanding frame members to the bottom ends of which a horizontal bed plate is mounted, and to the top ends of which a pair of hydraulic cylinders are mounted to reciprocatively drive a ram downward against the bed. The ram and bed are fitted with coacting dies and a work piece to be formed or sheared is placed between the dies. Upon actuation of a hand control switch or foot pedal by the operator, hydraulic power is supplied to the cylinders to bring the ram down with sufficient force to cause the dies to perform the desired forming or shearing action.

Where the length of the overall operating stroke of the ram is large relative to the working portion of the stroke, i.e. that portion of the stroke where pressure is actually applied to the work piece, provision is usually made in the hydraulic control system for advancing the ram initially at a relatively fast advance speed until the die nears contact with the work piece, and then for advancing the ram at a relatively slow pressing speed as the die actually engages the work piece and performs the desired forming or shearing operation. This results in a substantial savings in operator and machine time, without sacrificing the accuracy and safety achieved by the slow pressing speed.

An additional operational capability desirable in a ram control system is that it be capable of idling or holding the ram stationary at any selected position along its path of travel to permit the operator to reposition the work piece, or to set up the press brake for a subsequent operation. Furthermore, it is desirable that the system be capable of advancing the cam at its high or advance speed to a position adjacent the work, and holding it there until the operator actuates a hand switch or foot pedal to begin the actual pressing operation. Such high-stop-low (HSL) operation should preferably be entirely automatic and with a minimum amount of upward and downward creep of the ram. Since it is necessary for accurate bending and forming that the ram be brought squarely against the work piece with a minimum degree of tilt, i.e. variation from a desired angle of incidence, it is also desirable that the control system include tilt compensating means to adjust the hydraulic power applied to the cylinders to obtain an even descent.

To achieve the aforedescribed reciprocative operation of the ram, hydraulic press brake machines have been heretofore provided with a combined electrical and hydraulic control and actuator system which typically comprises multiple electrical limit switches disposed along the path of the ram to control its ascent and descent, and a differential valve responsive to the tilt of the ram to compensate for uneven descent. The limit switches, which are connected by appropriate electrical circuitry to solenoid-operated hydraulic valves, are mounted on the side of the press brake frame and operated by a cam actuator on the ram to control the application of hydraulic power to the cylinders. By adjusting the position of the switches the upward and downward travel limits of the ram can be preset, as well as the point at which the ram slows from its advance speed to its pressing speed. The differential valve, which is typically connected to the ram by a tape and pulley arrangement, compensates for uneven descent of the ram by reducing fluid flow to one or the other of the ram cylinders.

While such control and actuator systems have performed satisfactorily in larger press brakes, the hydraulic and electrical complexity of these systems has made them undesirably expensive for inclusion in lower capacity machines. Furthermore, the need for interlocking the hydraulic and electrical control circuits and the large number of solenoid-actuated valve required has precluded any significant degree of simplification or integration of the hydraulic and electric circuits of these systems. Thus, the need has developed for a less complex and more economical control and actuator system which provides the control functions found on larger and more expensive rams, including provision for advance and pressing speeds, HSL operation and ram alignment.

SUMMARY OF THE INVENTION

Accordingly, it is a general object of the present invention to provide a new and improved control and actuating system for a hydraulic press brake or the like.

It is a more specific object of the present invention to provide a new and improved control and actuating system for a hydraulic press brake which is simpler in design and more economical to manufacture.

It is another specific object of the present invention to provide a new and improved control and actuating system for a hydraulic press brake wherein individual hydraulic circuit components can be combined in a single hydraulic manifold.

It is another specific object of the present invention to provide a control and actuating system for a hydraulic press brake which utilizes a less complex electrical control circuit requiring fewer electrical limit switches.

It is another specific object of the present invention to provide a hydraulic control and actuating circuit for a hydraulic press brake which maintains a desired angle of incidence with a work piece without the need for a ram-connected tape and pulley-driven differential valve system.

It is another specific object of the present invention to provide a control and actuating system for a hydraulic press brake which provides accurate and stable idling of the ram at any preselected position.

It is another specific object of the present invention to provide a control and actuator system having a high-stop-low (HSL) function whereby the ram automatically stops just prior to engaging the work piece and remains in a stop position until actuation of a switch by the operator.

Accordingly, the invention is directed, in a hydraulic press brake of the type having a frame, a bed, and a ram disposed to reciprocate on the frame above the bed, to an actuator and control system for establishing a bottom travel limit for the ram. The system comprises a pair of hydraulic cylinders, each of the cylinders having a housing defining an inner chamber, a piston slidably disposed to reciprocate within the chamber, and a mechanical stop for limiting the maximum downward travel of the piston. Means comprising a pair of jackscrews turned into complementarily-threaded bores at one end of the pistons are provided for suspending the ram from the pistons, and ram height adjustment means are provided for rotating the jackscrews to adjust the spacing of the ram from said pistons, and hence the bottom limit position of the ram when the piston abuts the mechanical stop.

The invention is further directed, in a hydraulic press brake of the type having a frame, a bed, and a ram disposed to reciprocate on the frame above the bed, to an actuator and control system for establishing a top travel limit for the ram. The system comprises a pair of hydraulic cylinders, each having a housing defining a vertical chamber, a piston slidably disposed to vertically reciprocate within the chamber, and top and bottom ports for admitting hydraulic fluid above and below the piston. Means are provided for suspending the ram from the pistons to cause the ram to reciprocate therewith, and means comprising a hydraulic pump and reservoir are provided for supplying hydraulic fluid under pressure. Means comprising a pair of hydraulic valves having a mechanical actuator stem are provided for directing hydraulic fluid from the pump to the bottom ports of respective ones of the hydraulic cylinders, the pressure of the fluid so directed being dependent on the position of the actuator stem, and ram height adjustment means comprising a pair of valve actuator members on the ram are provided for actuating the mechanical valve stems as the ram reaches its top travel limit, thereby modulating the pressure admitted to the bottom ports of the cylinders to maintain the ram in the top limit position.

The invention is further directed, in a hydraulic press brake of the type having a frame, a bed, and a ram disposed to reciprocate on the frame above the bed, to an actuator and control system which comprises a pair of hydraulic cylinders, each of the cylinders having a housing defining an inner chamber, a piston disposed to reciprocate within the chamber, and top and bottom ports for admitting hydraulic fluid above and below the piston. Means are provided for suspending the ram from the pistons to cause the ram to reciprocate therewith, and means comprising a first hydraulic pump are provided for supplying hydraulic fluid under relatively high pressure and at a relatively low volume. Further included are means comprising a second hydraulic pump for supplying hydraulic fluid under relatively low pressure at a relatively high volume, and means including a first flow control valve having first and second positions for alternately connecting the first hydraulic pump to the bottom cylinder port or to the top cylinder port. Means including a one-way check valve are provided for connecting the output of the second hydraulic pump to the bottom port, and means including a second flow control valve having closed and open positions are provided for connecting the output of the second hydraulic pump to the reservoir. Further provided are means comprising a third flow control valve having closed and open positions for connecting the top cylinder port to the reservoir, and mode control means for maintaining the first flow control valve in its first position, the second valve open, and the third valve closed to idle the ram; or alternately the first valve in its second position, the second valve open and the third valve closed to move the ram downward; or alternately the first valve in its first position, the second valve closed and the third valve open to move the ram upward.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in connection with the accompanying drawings, in the several figures of which like reference numerals identify like elements, and in which:

FIG. 1 is a perspective view of a press brake incorporating a hydraulic actuator and control system constructed in accordance with the invention.

FIG. 2 is a front elevational view of the press brake partially broken away to show the ram height adjustment components, and partially in cross-section to show the ram actuating cylinder.

DESCRIPTION OF THE PREFERRED EMBODIMENT

Figure 3:
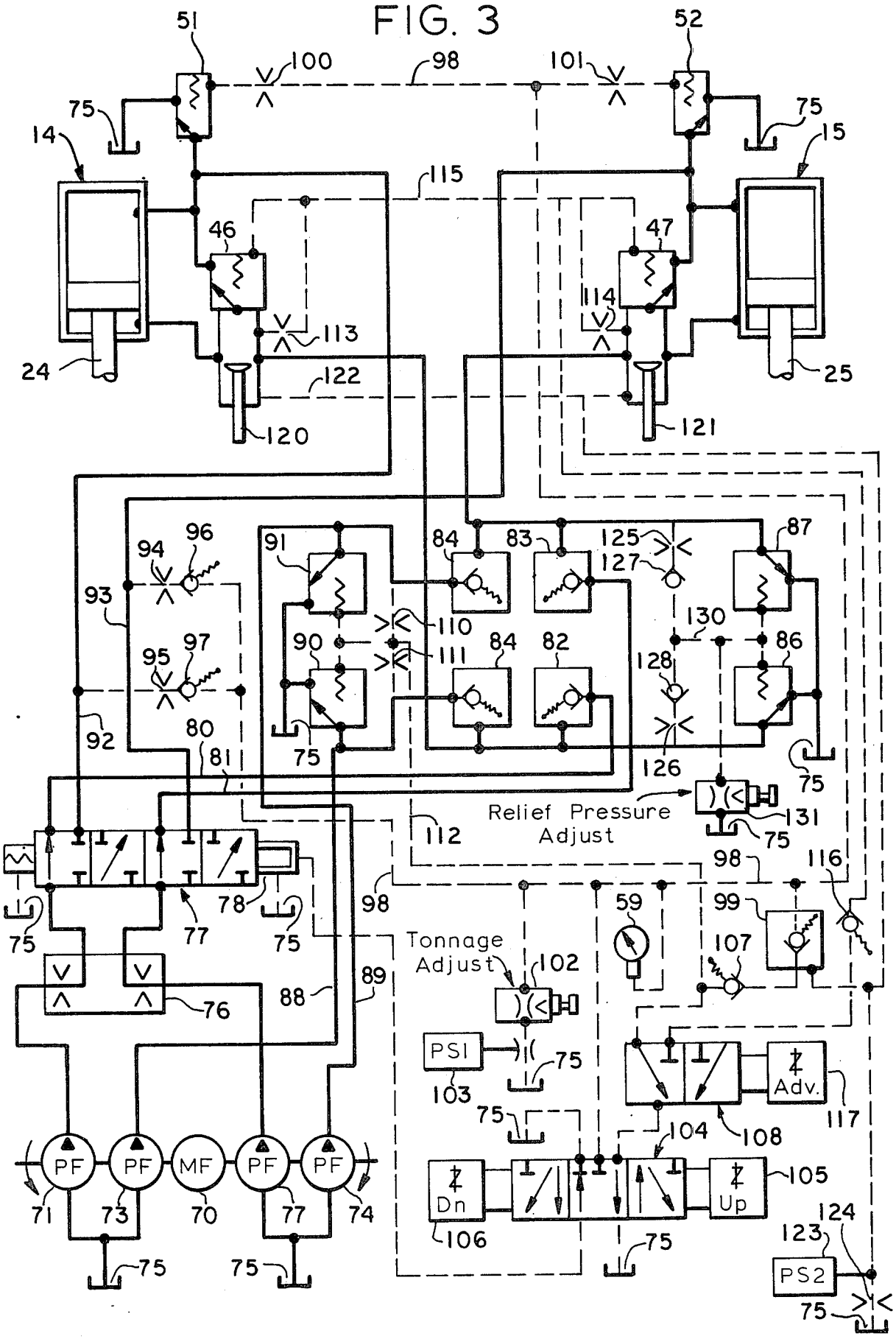
FIG. 3 is a simplified diagram of the hydraulic portion of the control and actuating system of the invention.

Referring to FIG. 1, the control system of the present invention is seen to be incorporated in a press brake 10 which, with the exception of its control and actuating system, may be conventional in design and construction. The press brake consists of a pair of heavy spaced-apart upstanding side plates 11 and 12 which are joined at their bottom ends by a bed plate 13. A pair of hydraulic cylinders 14 and 15 are mounted at the top ends of side plates 11 and 12, respectively. The pistons of these cylinders are connected to a ram member 16 which is constrained by the pistons to reciprocate along a predetermined vertical path extending from the cylinders to the top surface of bed plate 13. An upper die 17 is secured to the bottom edge of ram 16 and a lower die 18 is secured to the top of bed 13 to exert force on a work piece positioned between the two dies. While the dies may be of various shapes and sizes, they normally are structured to coact when brought into engagement under pressure to accomplish a forming or shearing operation on the intervening work piece. The two dies are readily changeable by the operator to accommodate spedific job functions.

Referring now to FIG. 2, ram 16 is seen to comprise a heavy gauge vertical plate 21 supported at either end by jackscrews 22 and 23 which engage the piston stems 24 and 25 of cylinders 14 and 15, respectively. The jackscrews include nonthreaded shaft portions at their lower end which extend downwardly through individual thrust bearings 26 and 27 at the top plate 21 and into respective ones of right-angle drives 28 and 29, the latter being mounted to the rear surface of ram plate 21 to turn the jackscrews. The threaded top portion of each jackscrew is threaded into a complementarily threaded bore on the piston stem such that when the shaft is turned the ram is raised or lowered. A pair of collars 30 and 31, slidably mounted to frame members 11 and 12, respectively, are provided for preventing the pistons from rotating as jackscrews 22 and 23 are turned. The right angle drives, which may comprise conventional worm gear-type drives, include input shafts 32 and 33 which extend horizontally to a bi-directional drive motor 34, which is also mounted to the rear surface of ram plate 21. A clutch 35, manually operated by means of a knob 36 on the front of plate 21, is located on shaft 33 to permit that shaft to be disengaged from motor 34 by the machine operator.

It will be appreciated that the effect of actuating motor 34 will be to raise and lower ram 16 ralative to the cylinder pistons to accommodate various sizes and shapes of work pieces between the die members. This also provides a positive bottom stop for ram 16, since the position of the ram is fixed relative to the pistons by jack screws 22 and 23, and a positive down-limit is provided for the pistons as the bottom faces 37 of the pistons come into contact with the bottom surfaces 38 of the piston housings.

The maximum upward travel of the ram is set by means of a novel hydraulic limit switch arrangement. Specifically, a transverse shaft 40 carried by journals (not shown) on collars 30 and 31 is fitted with a pair of gears 41 and 42 at either end, adjacent cylinders 15 and 16. These gears engage complementarily toothed rack surfaces on a pair of valve actuator rods 43 and 44, which are slidably mounted so as to move with the collars as the cylinders are actuated, and to move relative to the collars as shaft 40 is rotated. A knob 45 is provided at the right end of shaft 40 to facilitate rotation of the shaft to raise and lower the valve-actuating rods. A pair of poppet-type stem-actuated valves 46 and 47 are disposed above each of the valve actuator rods and fitted with appropriate linkages such that the top ends of the rods actuate the valve stems as the ram reaches the top limit of its travel. By adjusting the vertical height of the valve actuator rods the operator can preselect the point at which valves 46 and 47 are actuated during the upward travel of the ram. As will be seen presently, actuation of the valves stops the ram and causes it to be held stationary to await a subsequent pressing cycle. To enable the ram to be leveled at the top of its cycle the valve actuator rods 43 and 44 are provided with adjustable actuating surfaces in the form of knurled-edge flat-headed adjustment screws 48 and 49 threaded into the top ends of the rods and secured by locking nuts or other appropriate means. By turning one or the other of these adjustment screws any tilt in the ram, i.e. any departure from a true horizontal conditioner or a desired angle, can be compensated for by causing the valve on the high side of the ram to be actuated slightly sooner than that on the low side. An additional set of hydraulically-actuated poppet-type valves 51 and 52 adjacent the top ports of cylinders 14 and 15 coact with poppet valves 46 and 47 in controlling the hydraulic cylinders.

An electrical limit switch 53 is also provided on press brake 10 for causing the ram control circuitry to slow the ram from its advance speed to its pressing speed just prior to engaging the work piece. Referring to FIG. 1, this limit switch is mounted on sidewall 11, and is actuated by an actuator arm 54, which extends rearwardly from ram 16. The vertical position of actuator arm 54 is adjustable relative to ram 16 so that the point at which limit switch 53 is actuated during the downward stroke of the ram can be preset by the operator. In practice, actuator arm 14 is adjusted so that switch 53 is actuated just prior to the die 17 coming into contact with the work piece. This provides maximum efficiency and safety in operation of the press brake.

Operation of the press brake in its down or pressing mode may be initiated by either simultaneously depressing a pair of hand-operated push buttons 55 and 56 provided on a control panel 57 horizontally disposed along the front face of the machine, or by depressing foot-pedal operated switch 58. A tonnage indicator 59 may be provided on this panel to indicate the pressing effort of the machine, and the clutch actuator knob 36 of clutch 35 may also be provided on this panel for operator convenience.

As mentioned previously, for accurate pressing and forming it is necessary that the upper die 17 engage the work piece with a consistent angle of incidence, i.e. without tilt. In accordance with one aspect of the invention, tilting of ram 16 is minimized by accurately controlling its tilt at the top and bottom limits of its travel. It will be recalled that at the bottom limit of the ram the bottom faces 37 of the cylinder pistons abut the lower inside surfaces 38 of the cylinder housings. This establishes a fixed reference point at the bottom of each cylinder. Now, by adjusting jackscrews 22 and 23 the ram 16, and hence the upper die 17, can be accurately positioned with any desired degree of tilt and at any desired height above the lower die member 18. This is accomplished by first operating bidirectional motor 34 with clutch 35 engaged to achieve the desired separation between dies 17 and 18, and then operating motor 34 with clutch 34 disengaged for the desired bottom tilt angle. The tilt angle of the ram at its top limit of travel is next adjusted by positioning the ram at its desired top limit of travel and then turning hand wheel 45 until the stems of poppet valves 46 and 47 are actuated. The operator then turns one or both of the threaded adjustment screws 48 and 49 until the ram is leveled or the desired top tilt angle is achieved.

Referring to the simplified hydraulic diagram of FIG. 3, the hydraulic control and actuator system of press brake 10 is seen to include an electrical motor 70 which powers four fixed-displacement pumps; a pair of high-pressure low-volume pumps 71 and 72, and a pair of low-pressure high-volume pumps 73 and 74. The inputs of these pumps are connected to the system hydraulic reservoir 75. The outputs of the high-pressure pumps 71 and 72 are connected to opposed inputs of a pressure-equalizer 76, which is provided to balance the pressure in the two lines. The outputs of equalizer 76 are connected to input ports of respective sections of a two-section two-position four-way ram control valve 77. This valve is biased in a conventional manner by a vented spring actuator into its normal or up position, as shown in FIG. 3, but can be actuated into its transfer or down position by application of hydraulic pressure to actuator cylinder 78, which is vented to remove any hydraulic leakage which may enter from the valve body.

In the normal position of valve 77, i.e. that shown schematically on the left side of each section of the valve and obtainable when cylinder 78 is de-energized, the inlet ports of the valve are connected to the left-hand outlet ports and the right-hand outlets are blocked. The left-hand outlet ports of valve 77 are connected by hydraulic lines 80 and 81 to respective ones of forward-flow check valves to main ports of respective ones of poppet valves 82 and 83. The main inlet ports of poppet valves 46 and 47 are also connected to respective ones of reverse-connected check valves 84 and 85 and to respective ones of normally closed pilot-operated pressure relief valves 86 and 87. The outlet ports of valves 86 and 87 are connected to the hydraulic reservoir 75, and the inlet ports of check valves 84 and 85 are connected to hydraulic pumps 73 and 74 by hydraulic lines 88 and 89 and to reservoir 75 by respective ones of normally-closed pilot-operated valves 90 and 91.

The right-hand outlet ports of ram control valve 77 are connected by hydraulic lines 92 and 93 to the top ports of cylinders 14 and 15, respectively. The top port of cylinder 14 is also connected to the outlet port of poppet valve 46 and to the inlet port of poppet valve 51, and the top port of cylinder 15 is also connected to the outlet port of poppet valve 47 and to the inlet port of poppet valve 52. The outlet ports of poppet valves 51 and 52 are connected to the hydraulic reservoir 75.

Pressure for actuating the pilot-operated valves 51, 52 and 77 is obtained from hydraulic lines 92 and 93 by means of fixed orifices 94 and 95 and forward-flow check valves 96 and 97, these elements being connected to respective ones of the hydraulic lines to supply a common pilot line 98. Pilot line 98 is connected directly to a reverse-flow pilot-operated check valve 99, and by way of fixed orifices 100 and 101 to the control ports of valves 51 and 52. Pilot line 98 is also connected by an adjustable tonnage limit valve 102 and a flow-sensing switch 103 to reservoir 75. The tonnage limit valve 102, which may be a conventional pressure-relief valve, is located on control panel 57 and is normally adjusted by the machine operator to open at a pressure corresponding to a desired maximum pressing effort. A tonnage indicator 59, which may comprise a conventional hydraulic pressure gauge calibrated to indicate the pressing effort of the machine, is also connected to pilot line 98.

Pilot line 98 is also connected to the center port of a five-way three-position solenoid-operated direction control valve 104. In the center or neutral position of this valve, corresponding to an idle or static condition of the ram, this port is blocked. In the right-hand or up position of this valve, achieved by actuating a ram up valve control solenoid 105, the center port is connected to reservoir 75. In the left-hand or down position of this valve, achieved by actuating a ram down valve control solenoid 106, the center port is connected to cylinder 78, which it will be recalled actuates ram control valve 77 from its normal or up position to its down position. Valve 104 connects cylinder 78 to reservoir 75 in its neutral and up positions.

The outlet port of the pilot-operated check valve 99 is connected by a forward-flow check valve 107 to one inlet port of a solenoid-operated three-way two-position ram advance control valve 108. In the normal position of this valve, this inlet port is connected through an outlet port to the right-hand inlet port of valve 104. In the normal and down positions of this valve the inlet port is connected to reservoir 75 and in the up position of this valve the inlet port is blocked.

Hydraulic pressure for operating valves 90 and 91 is obtained from hydraulic lines 88 and 89 by way of fixed orifices 110 and 111 which connect respective ones of the lines to a common pilot line 112, which is connected to the control ports of the two relief valves. Pilot line 112 is also connected to the aforementioned inlet port of valve 108, check valve 107 preventing interaction thereof with pilot line 98.

Hydraulic pressure for operating poppet valves 46 and 47 is obtained by fixed orifices 113 and 114 which connect outlet ports of respective ones of the valves to a common pilot line 115, which is connected to the control ports of the two valves. Pilot line 115 is also connected by way of a forward-flow check valve 116 to a second input port of the cylinder advance control valve 108. In the advance position of this valve, obtained by energizing ram advance solenoid 117, this inlet port is connected to the outlet port of the valve, which it will be recalled is connected to the right-hand inlet port of direction control valve 104. The first inlet port of valve 108 is blocked when the valve is in its advance position.

The outlet ports of poppet valves 46 and 47, which communicate with the inlet ports when the control heads of the respective valves are depressurized and the pressure at the inlet ports is sufficient to overcome an internal spring force biasing the valve closed, or when the actuator stems 120 and 121 of the valves are actuated, are connected to the top ports of cylinders 14 and 15. Poppet valves 46 and 47 also include auxiliary outlet ports which communicate with the inlet port only when actuator stems 120 and 121 are actuated, as occurs when the ram reaches the upper extent of its travel. The two outlet ports are connected to a common pilot line 122, which in turn is connected to the control port of the pilot-actuated check valve 99 and to reservoir 75 by way of a pressure switch 123 and a fixed orifice 124.

Hydraulic pressure for actuating the pressure-relief valves 86 and 87 is obtained from the input lines to the valves by respective ones of fixed orifices 125 and 126 and check valves 127 and 128. These elements are connected to a common pilot line 130, the latter being connected to the control ports of valves 86 and 87 and by way of an adjustable pressre relied valve 131 to the hydraulic reservoir. Valve 131, like the tonnage limit valve 103, is operator-adjustable to open when the pressure in pilot line 130 exceeds a predetermined maximum level. As will be seen presently, this is useful in setting the holding pressure applied to the cylinders while the ram is in an idle or static holding condition.

Considering now the operation of the hydraulic circuit while the press brake is in a neutral or idling mode, as shown by the valve positions in FIG. 3, hydraulic pressure from the low-volume high-pressure pumps 71 and 72 is directed by valve 77 and hydraulic lines 80 and 81 through check valves 82 and 83 to the inlet ports of respective ones of the cylinder control poppet valves 46 and 47. Having assumed that the ram is at the upper extreme of its travel, the actuator stems 120 and 121 of valves 46 and 47 will be depressed by actuator rods 43 and 44, the latter having been previously positioned by the operator by means of knob 45 to bring the ram to rest in this position. The construction of valves 46 and 47 is such that when valve stems 120 and 121 are actuated a portion of the hydraulic pressure applied to the inlet ports is directed to the outlet ports of the valve, which it will be recalled are connected to the top ports of cylinders 14 and 15 and to reservoir 75 through valves 51 and 52, respectively. Thus, should the ram tend to rise valves 46 and 47 open and the hydraulic pressure applied to the bottom ports of the cylinders is reduced to counteract the rise. Should the ram tend to sink the valves close and increased hydraulic pressure is applied to the bottom ports of the cylinders to counteract further downward movement.

The cylinder exhaust poppet valves 51 and 52 are open at this time since no pressure is applied to their control ports by pilot line 98, the pressure supplied to the latter through fixed orifices 94 and 95 and check valves 96 and 97 being vented to reservoir 75 by the pilot-operated check valve 99, which is forced open by the pressure in pilot line 122 resulting from the valve actuator stems 120 and 121 being actuated. The output port of check valve 99 is connected through check valve 107, cylinder advance control valve 108 and direction control valve 104 to the hydraulic reservoir.

Hydraulic pressure from high-volume low-pressure pumps 73 and 74 is directed by hydraulic lines 88 and 89 to check valves 84 and 85 and relief valves 90 and 91, the latter being forced open at this time by reason of pilot line 112 being vented to reservoir 75 through valves 108 and 104. This reduces the pressure to the point that check valves 84 and 85 remain closed, allowing all of the low-pressure hydraulic fluid from pumps 73 and 74 to be vented to the reservoir for minimum energy loss in the low pressure system.

In the down operating mode of the press brake machine, initiated by the operator actuating electrical switches 55 and 56 or foot switch 58, solenoids 106 and 117 are energized and control valves 104 and 108 are transferred from their normal positions to their down and advance positions, respectively. Since pilot line 98 is now pressurized by reason of the drain path through cylinder advance control valve 108 being closed, poppet valves 51 and 52 are closed and the actuating cylinder 78 of ram control valve 77 is pressurized by way of the path established through valve 104. The shift of valve 108 to its advance position also causes pilot line 115 to be vented to the hydraulic reservoir through check valve 116, forcing poppet valves 46 and 47 to open, and further causes pilot line 112 to become pressurized forcing drain valves 90 and 91 to close and check valves 84 and 85 to open. This results in the top port of each cylinder being connected to the bottom port of that cylinder, and the outputs of both the high-pressure pumps 71 and 72 and the low-pressure pumps 73 and 74 to be simultaneously applied to the interconnected ports. Since the area on top of the pistons in the cylinders is greater than that on the bottom of the pistons, typically by a ratio of two to one, the net effect of these connections is to force the pistons down at their fast or advance speed. As the ram leaves its top limit position the valve actuator stems 120 and 121 are released and pilot line 122 is depressurized through orifice 124. This causes the pilot-operated check valve 99 to close but has no immediate effect no machine operation because the associated inlet port of valve 108 is blocked.

The pistons continue to advance at their advance speed until the actuator bar 54 provided on ram 16 actuates limit switch 53, it being recalled that the latter is positioned so as to be actuated just prior to the lower die 17 coming into contact with the work piece. Upon actuation of switch 53, solenoid 117 is de-energized and the ram advance control valve 108 returns to its normal position. This opens a drain path for pilot line 112, opening valves 90 and 91, and closes the drain path for pilot line 115, causing poppet valves 46 and 47 to close. By reason of valves 90 and 91 being open, the high-volume low-pressure fluid from pumps 73 and 74 is vented to reservoir 75, check valves 84 and 85 preventing the fluid trapped in the lower portion of cylinders 14 and 15 from also venting. Instead, the fluid trapped in the lower portion of cylinders 14 and 15 vents through pressure relief valves 86 and 87, the variable pressure relief adjustment valve 131 being set to open valves 86 and 87 at a suitably low pressure. In this manner, a controlled stabilizing back pressure is exerted on the cylinder as it enters its low speed pressing mode. Poppet valves 51 and 52 remain closed during this portion of the down stroke by virtue of the pressure in pilot line 98.

As the dies engage the work piece additional pressure is exerted by the hydraulic system on the top surface of the piston, until the net force developed on the piston is sufficient to achieve the desired bending or forming operation. It will be appreciated that the pressure in pilot line 98 is proportional to the pressure developed in the cylinders; and that gauge 59 as connected is affected by this pressure. By recalibrating the scale of gauge 59 to reflect the net force resulting on the cylinder as a result of the metered pressure, a tonnage read-out is obtained. The maximum tonnage adjustment valve 102 is set by the operator such that when the pressure developed in pilot line 98 corresponds to a desired pressing effort, valve 102 opens and hydraulic fluid from line 98 is vented to reservoir 75. This results in poppet valves and 52 immediately opening, thereby releasing pressure from the cylinder pistons and peventing excessive pressing force from being exerted. The opening of relief valve 102 also results in actuation of flow switch 103, the latter causing the electrical circuitry of the system to initiate a return cycle.

In connection with operation of the press brake in its pressing mode, it will be recalled that a high-stop-low (HSL) operating mode is possible whereby the ram, instead of initially advancing at advance speed and then slowing to a pressing speed, initially advances at advance speed and comes to a stop prior to contacting the work piece. This is accomplished by appropriate changes within the electrical circuitry, presently to be described which cause the closure of limit switch 53 to simultaneously return control valves 104 and 108 to their normal or stop positions. This depressurizes cylinder 78, causing valve 77 to return to its normal position. Poppet valves 51 and 52 remain closed by reason of the pressure in pilot line 98, and poppet valves 46 and 47 remain closed by reason of pilot line 115 being blocked by valve 108. Control valves 90 and 91 are forced open and check valves 84 and 85 are forced closed by reason of pilot line 112 being vented, the low-pressure hydraulic fluid now in lines 88 and 89 being drained to reservoir 75 for minimum heat loss in the system. Thus, the only source of oil to the cylinders is from low-volume high-pressure pumps 71 and 72 through valve 77 and check valves 82 and 83, this oil being maintained at a sufficient pressure by pressure relief adjustment valve 131 and relief valves 86 and 87 to exert an upward force greater than the weight of the pistons and ram. However, since the area above the pistons is sealed by reason of valves 51 and 52 being closed, the trapped oil above the piston prevents the piston from moving upward and therefore causes it to be held in a stationary position. This condition continues until the operator again actuates run switches 55 and 56 or foot switch 58, at which time solenoid 106 is again energized and the system enters the previously-described pressing mode.

Upon completion of the pressing operation, as signaled by the closing of switch 103 when the desired pressing effort is obtained, solenoid 105 is energized and the direction control valve 104 is shifted to its up position. Valve 104 now vents the actuator piston 78 of ram control valve 77 to reservoir 75, causing high-pressure hydraulic fluid to proceed through lines 80 and 81, check valves 82 and 83, and poppet valves 46 and 47 to the bottom ports of cylinders 14 and 15. Since bypass valves 90 and 91 are closed at this time by reason of pilot line 112 being blocked by valve 104, low-pressure high-volume hydraulic fluid from pumps 73 and 74 also enters the bottom ports of cylinders 14 and 15. Poppet valves 46 and 47 are closed by reason of pilot line 115 being blocked by valve 108, so that all of the fluid enters the cylinders below the pistons. Poppet valves 51 and 52 are forced open by venting pilot line 98 through valve 104 to allow the oil above the pistons to vent directly to reservoir 75. Since the pressure required to raise the ram is less than the setting of relief valve 131 when the top cylinder ports are vented, the pistons are caused to raise the ram.

The ram continues to rise until the valve actuator rods 43 and 44, which it will be recalled were set to engage the valve stems 120 and 121 at the top limit of ram travel, engage the stems to partially open valves 46 and 47 and pressurize pilot line 122. Pressurization of pilot line 122 opens pilot-operated check valve 99 and actuator pressure switch 123, which results in the ram up valve control solenoid 105 being de-energized and valve 104 being returned to its normal or center position. Pilot line 98 is now vented through check valve 99, valve 108 and valve 104, allowing poppet valves 51 and 52 to remain open. The ram is now held in position by the previously described top limit holding action of valve stems 120 and 121, which it will be recalled automatically regulate the pressure on the bottom surfaces of the pistons to maintain the ram steady at its top limit of travel.

Figure 4:
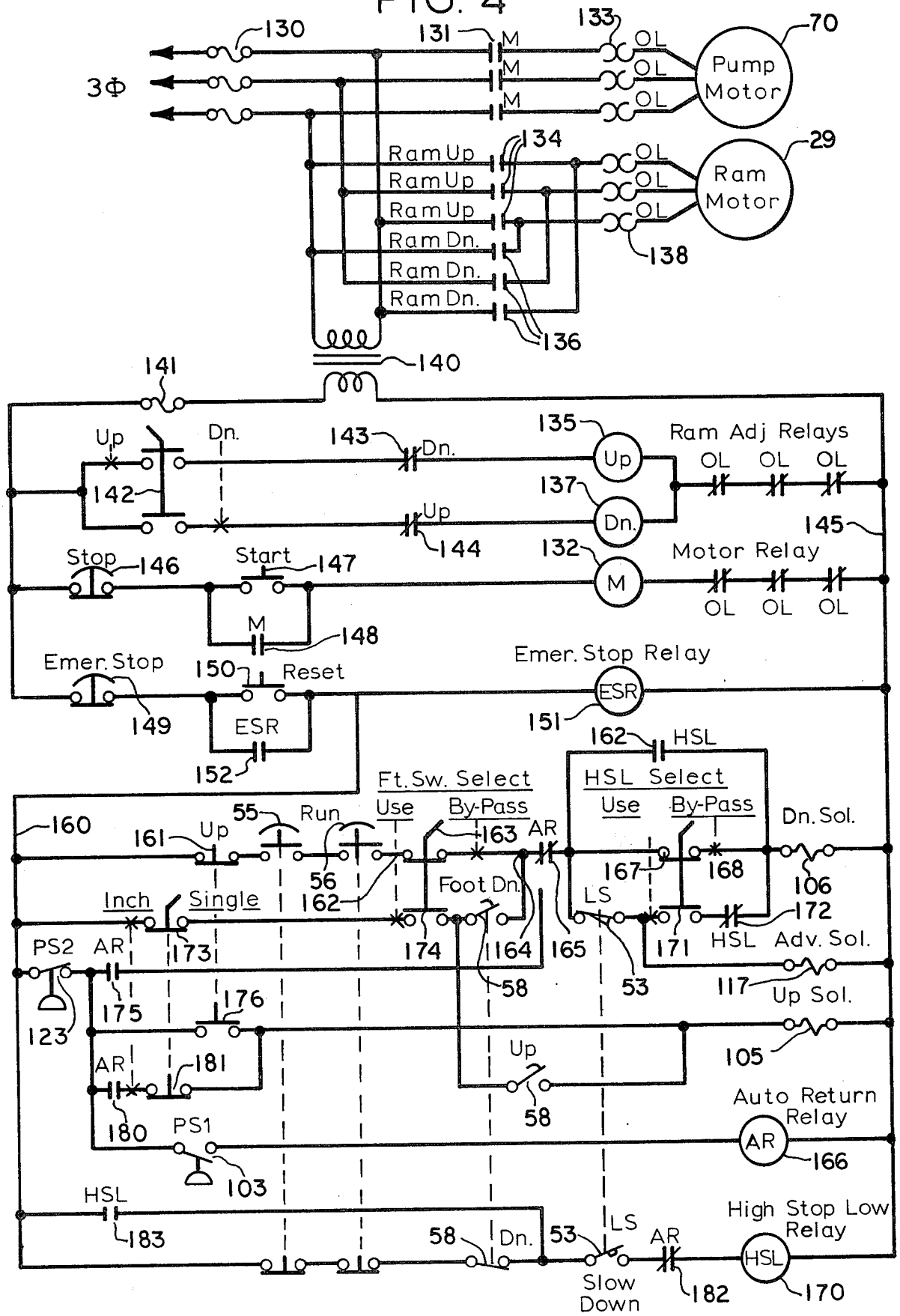
FIG. 4 is a simplified schematic diagram of the electrical portion of the control and actuating system of the invention.

Having considered the operation of the hydraulic control circuit in each of the operating modes of the press brake, it remains to consider the associated electrical circuitry. Referring to the simplified electrical diagram of FIG. 4, the hydraulic pump motor 70 is supplied from a three phase alternating current line by way of individual fuses 130, the normally-open contacts 131 of a motor control relay 132, and the sensing elements of individual circuit breakers 133. The ram height adjustment motor 29 is also supplied with three phase alternating current, either by way of a set of three-normally open contacts 134 associated with a ram-up relay 135, or by way of a set of three normally-open contacts 136 associated with a ram-down relay 137, the contacts being arranged to achieve reversal of the motor by alternately supplying the three phase current at reversed phase. Sensing elements of individual circuit breakers 138 are provided in series with the motor for overload protection.

A step-down transformer 140 is connected across two legs of the AC line to provide a low-voltage current source for the control circuits. One terminal of the secondary winding of transformer 140 is connected by way of a fuse 141 to an UP-OFF-DOWN ram adjustment control switch 142. In the UP position this switch connects the low-voltage line from transformer 140 through a set of normally closed contacts 143 of ram down relay 132 to the coil of ram up relay 135. In the DOWN position of switch 142, the low-voltage line is connected by normally-closed contacts 144 of ram up relay 135 to the coil of ram down relay 137. The coils of relays 135 and 137 are returned to transformer 140 by the normally closed contacts of overload circuit breakers 138 and a return line 145, which is connected to the remaining terminal of the secondary winding of transformer 140. The low-voltage AC line is further connected to one terminal of a normally closed STOP push-button switch 146, the other terminal of which is connected to one terminal of a normally-open START push-button switch 147. The other terminal of START switch 147 is connected to the coil of motor control relay 132, the coil being returned to transformer 140 by way of the three normally-closed contacts of the motor overload relay 133 and return line 145.

The low-voltage line is further connected to one terminal of a normally-closed EMERGENCY STOP push-button switch 149, the other terminal of this switch being connected to one terminal of a normally-open RESET push-button switch 150. The other terminal of RESET switch 150 is connected to the coil of an emergency stop relay (ESR) 151, this relay being returned to transformer 140 by way of return line 145. The contacts of RESET switch 150 are paralleled by a set of normally-open contacts 152 of relay 151. The other terminal of RESET switch 150 is also connected to a control line 160, which supplies low-voltage alternating current for operating the various solenoids and relays utilized in controlling the hydraulic system of the press brake.

Control line 160 is connected by the normally-closed contacts of a RAM UP push-button switch 161 and the normally open contacts of RUN push-button switches 55 and 56 to a pair of contacts 162 of a FOOT SWITCH SELECT switch 163. Contacts 162 are connected to a juncture 164, and then by a set of normally closed contacts 165 of an auto-return relay 166 to a set of contacts 167 of an HSL SELECT switch 168. Contacts 167 are connected to ram down valve control solenoid 106, the solenoid being returned to transformer 140 by line 145. Contacts 167 are paralleled by a set of normally-open contacts 169 of a high-stop-low (HSL) relay 170. Contacts 167 are also paralleled by the series combination of a set of normally-closed contacts of limit switch 53, an additional set of contacts 171 of switch 168, and a set of normally-closed contacts 172 of HSL relay 170. The juncture of the normally-closed contacts of limit switch 53 and contacts 171 is connected to one terminal of ram advance solenoid 117, the other terminal of this solenoid being connected to return line 145.

Control line 160 is also connected by an INCH-SINGLE mode control switch 173, an additional set of contacts 174 of FOOT SWITCH SELECT switch 163, and a set of normally-open contacts which close when the DOWN pedal of foot-operated switch 58 is actuated, to juncture 164. Control line 160 is also connected by the normally-closed contacts of pressure switch 123 and by a set of normally-open contacts 175 of auto-return relay 166 to juncture 164. Pressure switch 123 is also connected by normally-open contacts 176 of the RAM UP switch to one terminal of the ram up valve control solenoid 105.

Solenoid 105 is further connected by normally-open contacts which close when the UP pedal of foot-operated switch 58 is actuated to the juncture of contacts 174 and the normally-open DOWN contacts of the foot-operated switch 58. Switch 123 is also connected by a set of normally-open contacts 180 of auto-return relay 166 and by a set of normally-closed contacts 181 of the INCH-SINGLE selector switch to up solenoid 105. Pressure switch 123 is also connected by the normally-open contacts of flow sensing switch 103 to one terminal of the auto-return relay 166, the other terminal of this relay and the other terminal of solenoid 105 being connected to return line 145.

Control line 160 is connected by the series combination of normally-closed contacts of RUN switches 55 and 56, normally-closed contacts which open when the DOWN pedal of foot-operated switch 58 is actuated, and normally-closed contacts 182 of auto-return relay 166 to the coil of HSL relay 170. The other terminal of this coil is connected to return line 145. Control line 160 is also connected by a set of normally-open contacts 183 of HSL relay 170 to the juncture of the normally-closed contacts of DOWN foot switch 58 and the normally-open contacts of slow-down limit switch 53.

In operation, the hydraulic pump motor 70 is placed in operation by momentarily depressing START switch 147, which energizes motor control relay 132. This causes the normally-open holding contacts paralleling start switch 147 to close, which maintains relay 132 energized. Motor 70 may be stopped by momentarily depressing STOP switch 146, which drops out the relay and hence stops the motor. The ram is adjusted by momentarily actuating switch 142 to its UP or DOWN position, thereby energizing either relays 135 or 137. The normally-closed contacts in series with these relays preclude simultaneous actuation of both relays, and the normally-closed series contacts of the overload detectors 138 interrupt current to the relays in the event of an overload condition.

Prior to initial operation of the press brake, it is necessary to momentarily actuate RESET switch 150 to energize emergency stop relay 151. Once thus energized, this relay is maintained energized by the holding contacts 152 paralleling RESET switch 150. The machine may be stopped at any time by actuating EMERGENCY STOP switch 149, which de-energizes relay 151 and removes power from the control circuits of the machine.

Assuming initially that the FOOT SWITCH BYPASS switch 163 is in its BYPASS position, and that the HSL SELECT switch 168 is also in its BYPASS position, the ram can be caused to descend by simultaneously depressing RUN switches 55 and 56. This causes current to be supplied through the normally-closed contacts 165 of auto-return relay 166 to ram down valve control solenoid 106. Also, current is supplied through the normally-closed contacts of limit switch 53 to the ram advance valve control solenoid 117. Since both down solenoid 106 and advance solenoid 117 are energized, the hydraulic system is conditioned to its advance mode, as previously described. When the ram descends to the point where limit switch 53 is actuated, solenoid 117 is de-energized, causing the ram to continue downward at its slower pressing speed.

As the ram engages the work piece, it will be recalled that the pressure in pilot line 98 eventually builds to the point where the tonnage limit valve 102 opens and causes flow switch 103 to be actuated. In the electrical circuit of FIG. 4, this results in current from line 160 being supplied through normally closed switch 123 and switch 103 to the auto-return relay 166. Upon energization of this relay, the normally-closed contacts 172 in series with ram down valve control solenoid 106 open to cause that solenoid to become de-energized. At the same time, assuming the INCH-SINGLE switch is in its SINGLE position, current is applied to the ram up valve control solenoid 105 through the normally-open contacts 180 of relay 166 and the closed contacts 181 of the switch. Should the switch instead be in its INCH position, it would be necessary to actuate the RAM UP switch to apply power through the normally-open contacts 176 of that switch to solenoid 105. Once the ram up cycle has been initiated, the ram continues to move upward until the valve actuator rods 43 and 44 engage the actuator stems 120 and 121 of poppet valves 46 and 47, which it will be recalled causes pilot line 122 to become pressurized and pressure switch 123 to be energized, opening the normally-closed contacts of that switch. Because the normally open contacts 175 of auto-return relay 166 are still closed, should DOWN foot switch 58 or RUN switches 55 and 56 still be actuated at this point auto-return relay 166 will remain energized, holding contacts 165 open and thereby preventing the ram from automatically recycling until the switches have been released.

Should FOOT SWITCH SELECT switch 163 be placed in its USE position, the RUN switches 55 and 56 are disabled and the UP and DOWN pedals of foot switch 58 are enabled. The DOWN pedal of switch 58 serves the same purpose as RUN switches 55 and 56, energizing the ram down valve control solenoid 106 and the ram advance solenoid 117, and the UP pedal of switch 58 serves the same purpose as the RAM UP switch, energizing the ram up valve control solenoid 105.

The high-stop-low (HSL) circuit of the press brake is activated by positioning the HSL SELECT switch 168 to its USE position. The ram down valve control solenoid 106 and the ram advance ram control solenoid 117 are now both de-energized upon actuation of limit switch 53. At the same time, providing RUN switches 55 and 56 and the foot-operated DOWN switch 58 are all released, the closure of the normally-open contacts of limit switch 53 causes HSL relay 170 to be energized. This causes the normally-open contacts 162 bypassing switch 168 to close, allowing only the ram down solenoid 106 to be energized by actuation of RUN switches 55 and 56 or DOWN foot switch 58. Since the ram advance solenoid 117 is not energized by reason of the normally closed contacts 172 of HSL relay 170 being open, the ram proceeds at its pressing speed following the HSL stop. It should be noted that before HSL relay 170 can be energized it is necessary that RUN switches 55 and 56 and DOWN foot switch 58 be released. Once relay 170 has been energized and the ram is being idled, the normally-open contacts 183 shunting the RUN and DOWN switches allow the switches to be actuated to complete the down cycle without dropping out HSL relay 170. Thus, the ram is brought at its advance speed to a point of near engagement with the work piece, where it is stopped and idled until the operator releases and again depresses the RUN switch, or the DOWN foot switch, whichever is in use, at which time the ram proceeds at its pressing speed to complete the down cycle.

Thus, the press brake control and actuating system of the invention provides the operational features of larger and more complex control systems, but with fewer and more economical components for greater reliability and reduced cost. Provision is made in the novel hydraulic circuit of the system for advancing the ram at both fast advance and slow pressing speeds, for idling the ram at a selected point, and for providing a high-stop-low (HSL) operating mode. Tilt compensation of the ram is obtained by providing fixed top and bottom stop positions; a stem-actuated poppet valve and adjustable ram-mounted actuator rod arrangement being operative at the top end of the stroke for presetting the top limit, and a cylinder stop and jackscrew arrangement being operative at the bottom end of the stroke for setting the down limit. This obviates the need for more complex tape and pulley arrangement employed in larger capacity hydraulic press brake machines.

The electrical circuitry of the control and actuator system of the invention does not require multiple limit switches for sensing ram position, but instead relies on pressure and flow sensing switches in the hydraulic circuit for initiating and terminating the various ram operating cycles. In addition to simplifying the electrical system, this arrangement provides a simplified and faster set up of the machine. The hydraulic circuitry of the system, by virtue of its extensive use of pilot-operated valves, is economical to construct and is particularly well adapted for integration into a single hydraulic manifold.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. In a hydraulic press brake of the type having a frame, a bed and a ram having a forward working end and a rear driving end and disposed to reciprocate on said frame along a defined operating path whereby said forward working end is caused to alternately move toward and away from said bed, an actuator and control system for said ram comprising, in combination:

a pair of hydraulic cylinders mounted on said frame adjacent opposite sides of said ram, said cylinders each having a housing defining an inner chamber, a piston slidably disposed to reciprocate within said chamber in a direction parallel to said defined operating path, and a mechanical stop for limiting the maximum downward travel of said piston to a predetermined bottom position with respect to said bed;

means for limiting the maximum upward travel of said piston to a predetermined top position with respect to said bed, including hydraulic valve means associated with each piston for selectively controlling the flow of hydraulic fluid thereto for upward movement, actuator means carried by said ram and cooperatively associated with said hydraulic valve means to operate said valve means when said piston reaches the desired upward travel limit;

ram suspension means including a pair of jackscrews each attached at one end to respective sides of said ram and arranged for free rotation with respect thereto, and each turned into complementarily-threaded bores in respective ones of said pistons at their other end whereby the sides of said ram are suspended from said pistons at respective predetermined spacings with respect to said pistons; and ram height adjustment means for rotating said jackscrews to adjust said spacings between said ram and said pistons, and hence the bottom and top travel limit of said ram along said defined operating path when said pistons reach said predetermined bottom and top positions respectively.

2. A hydraulic press brake in accordance with claim 1 in which each of said hydraulic valve means includes a stem actuator, the pressure of hydraulic fluid through said valve means being reduced as said actuator stem is actuated, said actuator means carried by said ram being disposed to engage said actuator stem when said ram reaches said desired upward travel limit.

3. A hydraulic press brake in accordance with claim 1 in which said actuator means carried by said ram comprises a rotary shaft carried by said ram and extending between the ends of said ram, said rotary shaft having a gear disposed at each end thereof, a pair of actuator rods disposed vertically at opposite ends of said ram, each of said rods having a toothed rack portion in engagement with one of said gears at each end of said rotary shaft for movement with said ram, each said actuator rod being disposed to engage one of said hydraulic valve means upon upward movement of said ram, whereby a maximum upward travel limit may be selected by rotating said shaft, thereby adjusting the vertical position of said actuator rods and, therefore, the upper travel limit for said ram.

4. A hydraulic press brake in accordance with claim 1 in which each of said actuator means includes a separate vertical adjustment means for setting maximum upward travel, whereby said ram may be leveled or tilted as desired.

5. A hydraulic press brake as defined in claim 1 wherein said ram height adjustment means include means for rotatably coupling said jackscrews such that said jackscrews are simultaneously turned in either direction.

6. A hydraulic press brake as defined in claim 5 wherein said ram height adjustment means further include operator-controlled tilt adjustment means whereby said jackscrews can be individually turned to adjust the tilt of said ram with respect to said bed.

7. A hydraulic press brake as defined in claim 6 wherein said ram height adjustment means include a bidirectional motor, and said tilt adjustment means include a clutch for selectively uncoupling said motor from one of said jackscrews.

* * * * *